US006161959A

United States Patent [19]

Abraham

[11] Patent Number: 6,161,959

[45] Date of Patent: Dec. 19, 2000

[54] STORAGE BAG WITH LOCKABLE ZIPPER

[75] Inventor: Morris Abraham, Deal, N.J.

[73] Assignee: Vipac, Inc., Edison, N.J.

[21] Appl. No.: 09/501,456

[22] Filed: Feb. 10, 2000

[51] Int. Cl.[7] ..... B65D 33/25; B65D 33/34

[52] U.S. Cl. ..... 383/97; 383/5; 24/387

[58] Field of Search ..... 383/5, 97; 190/120, 190/903; 150/101, 102; 70/68; 24/387, 390; 292/318, 319, 320, 321

[56] References Cited

U.S. PATENT DOCUMENTS

| | | | |
|---|---|---|---|
| 3,102,311 | 9/1963 | Martin et al. . | |
| 3,971,458 | 7/1976 | Koenig | 190/120 |
| 4,031,724 | 6/1977 | Atkinson | 70/68 |
| 4,042,267 | 8/1977 | Clinch et al. . | |
| 4,112,990 | 9/1978 | Anderson | 383/97 |
| 4,198,772 | 4/1980 | Furutu . | |
| 4,240,183 | 12/1980 | Sumimoto et al. . | |
| 4,420,857 | 12/1983 | Clay . | |
| 4,494,592 | 1/1985 | Bonner | 383/97 X |
| 4,501,049 | 2/1985 | Adamson . | |
| 4,537,432 | 8/1985 | Meeks . | |
| 4,573,242 | 3/1986 | Lankton et al. . | |
| 4,602,405 | 7/1986 | Sturman et al. | 383/97 X |
| 4,661,990 | 4/1987 | Rifkin | 383/97 |
| 4,680,834 | 7/1987 | Andre et al. . | |
| 4,785,960 | 11/1988 | Belisle | 383/5 X |
| 4,862,561 | 9/1989 | Lichtenberg . | |
| 4,866,816 | 9/1989 | Caveney . | |
| 4,976,120 | 12/1990 | Terada et al. . | |
| 5,081,855 | 1/1992 | Terada et al. | 70/68 |
| 5,103,657 | 4/1992 | Horita et al. . | |
| 5,890,265 | 4/1999 | Christian et al. . | |

*Primary Examiner*—Jes F. Pascua
*Attorney, Agent, or Firm*—Gottlieb, Rackman & Reisman, P.C.

[57] ABSTRACT

A storage unit or bag with a lockable closure mechanism is provided. The storage unit includes a container formed with an opening to provide access thereinto, and a cover sized for selective placement and covering over the opening of the container in order to prevent access. A mechanism such as a zipper system is provided for selectively closing the cover over the opening of the container. The zipper mechanism includes a first locking member, and the bag itself has a second locking member attached thereto by a fabric, string or other element. The two locking members are designed to interlock with one another in order to prevent the zipper system from operating. Accordingly, in order to gain access into the bag, it is necessary to cut the fabric or string extending from the second locking member.

18 Claims, 3 Drawing Sheets

FIG.3
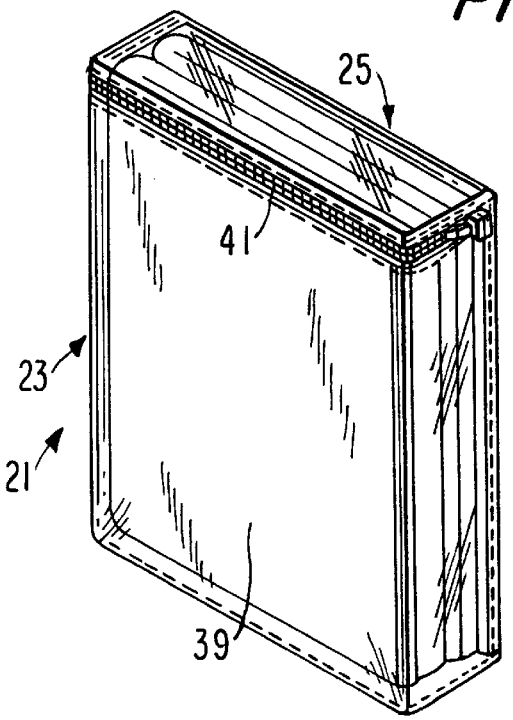
FIG.4
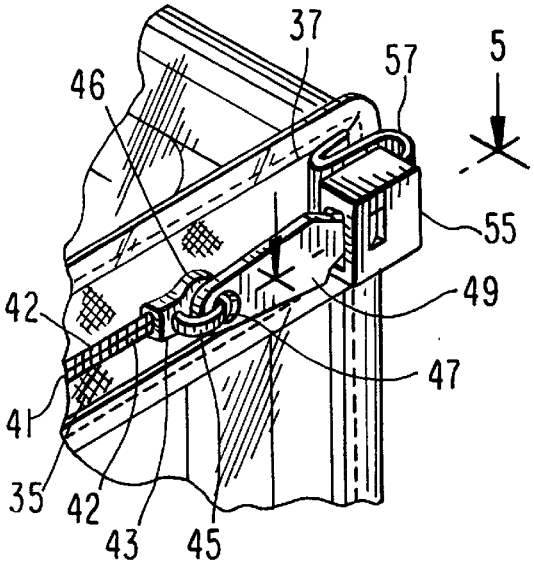
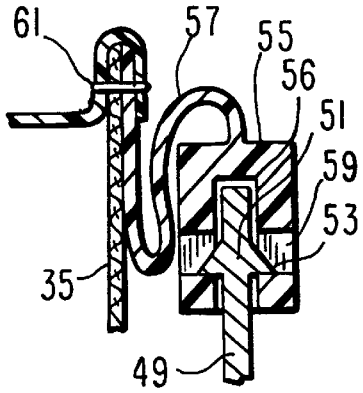
FIG.5

FIG. 6
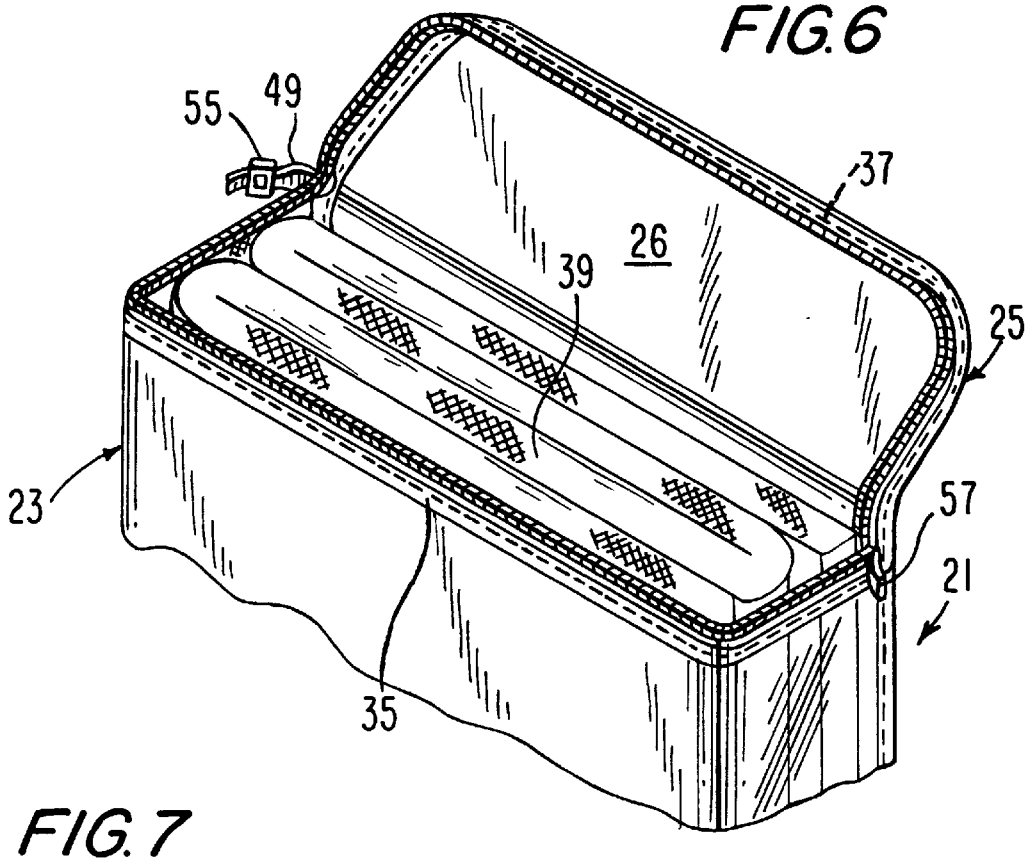
FIG. 7
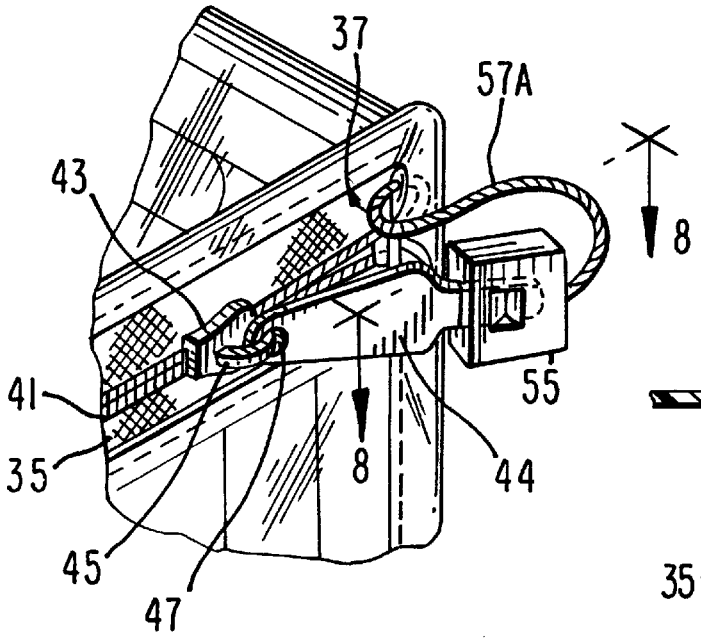
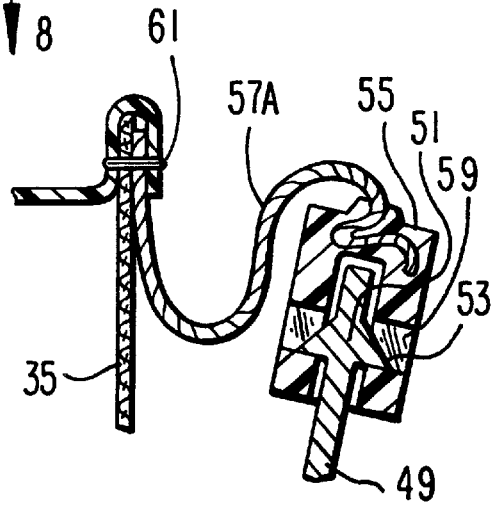
FIG. 8

STORAGE BAG WITH LOCKABLE ZIPPER

BACKGROUND OF THE INVENTION

This invention relates to a storage unit or bag, and more particularly, to plastic storage bags of the type for retaining textile products of various kinds and types, having a lockable zipper for preventing unintended access to the inside of the bag.

As is well known, large clear and flexible plastic bags are used to enclose bedspreads, sheets and other similar textile products when sold in retail department and boutique stores. These types of plastic bags are conventionally closed by a zipper or zipper mechanism of a conventional type.

One problem with selling bedspreads and other similar textile items in large clear plastic bags is that shoppers often hide small, unsold items in the bags in order to pilfer them.

Accordingly, it would be desirable to provide a bag or other type of storage unit which overcomes the above disadvantage.

SUMMARY OF THE INVENTION

Generally speaking, in accordance with the invention, a storage unit or bag with a lockable closure mechanism is provided. The storage unit includes a container formed with an opening to provide access thereinto, and a cover sized for selective placement and covering over the opening of the container in order to prevent access.

Significantly, a mechanism such as a zipper system is provided for selectively closing the cover over the opening of the container. The zipper mechanism includes a first locking member, and the bag itself has a second locking member attached thereto by a fabric, string or other element. The two locking members are designed to interlock with one another in order to prevent the zipper system from operating. Accordingly, in order to gain access into the bag, it is necessary to cut the fabric or string extending from the second locking member.

In the preferred embodiment, the lockable zipper system comprises a male member that is attached to or is part of a conventional zipper pull. The male member is lockable to a female element and the female element is attached to a portion of the container or bag. When the male and female elements are locked one into the other, they cannot be detached, and the zipper system is not operational unless the string or other member which connects the female element to a portion of the container or bag is cut or otherwise severed.

In accordance with the invention, the string or other member which connects the female element to a portion of the bag is specifically cut by the consumer only after purchasing the product at a retail establishment—the zipper mechanism then becomes operational. On the other hand, if a store sales person or representative notices before purchase that the string has been severed, he or she can reasonably presume that the bag's zipper mechanism has been compromised, and that an item of some type may be hidden within the bag.

Accordingly, it is an object of the invention to provide an improved storage or bag unit for carrying textile and other consumer products.

Still another object of the invention is to provide an improved storage or bag unit having a lockable zipper mechanism.

Yet a further object of the invention is to provide an improved storage or bag unit which prevents shoppers and consumers from hiding small, unsold items in the unit or bag.

Still other objects and advantages of the invention will in part be obvious, and in part be apparent from the following description.

BRIEF DESCRIPTION OF THE DRAWINGS

For a fuller understanding of the invention, reference is made to the following description, taken in connection with the accompanying drawings, in which:

FIG. 3 is a perspective view directed to the storage bag or unit of the invention in which the bag or unit is in a closed or sealed condition with the textile item retained therein;

FIG. 4 is a front perspective view of the zipper locking mechanism of the inventive storage bag or unit;

FIG. 5 is a cross-sectional view taken along lines 5—5 of FIG. 4;

FIG. 6 is a front perspective view of the top portion of the inventive storage bag or unit after the member which connects the female element of the locking mechanism to a portion of the bag or unit has been severed;

FIG. 7 is a front perspective view of an alternative embodiment of the zipper locking mechanism of the inventive storage bag or unit; and FIG. 8 is a cross-sectional view taken along lines 8—8 of FIG. 7.

DETAILED DESCRIPTION OF THE PREFERRED EMBODIMENT

Figures 1, 2:
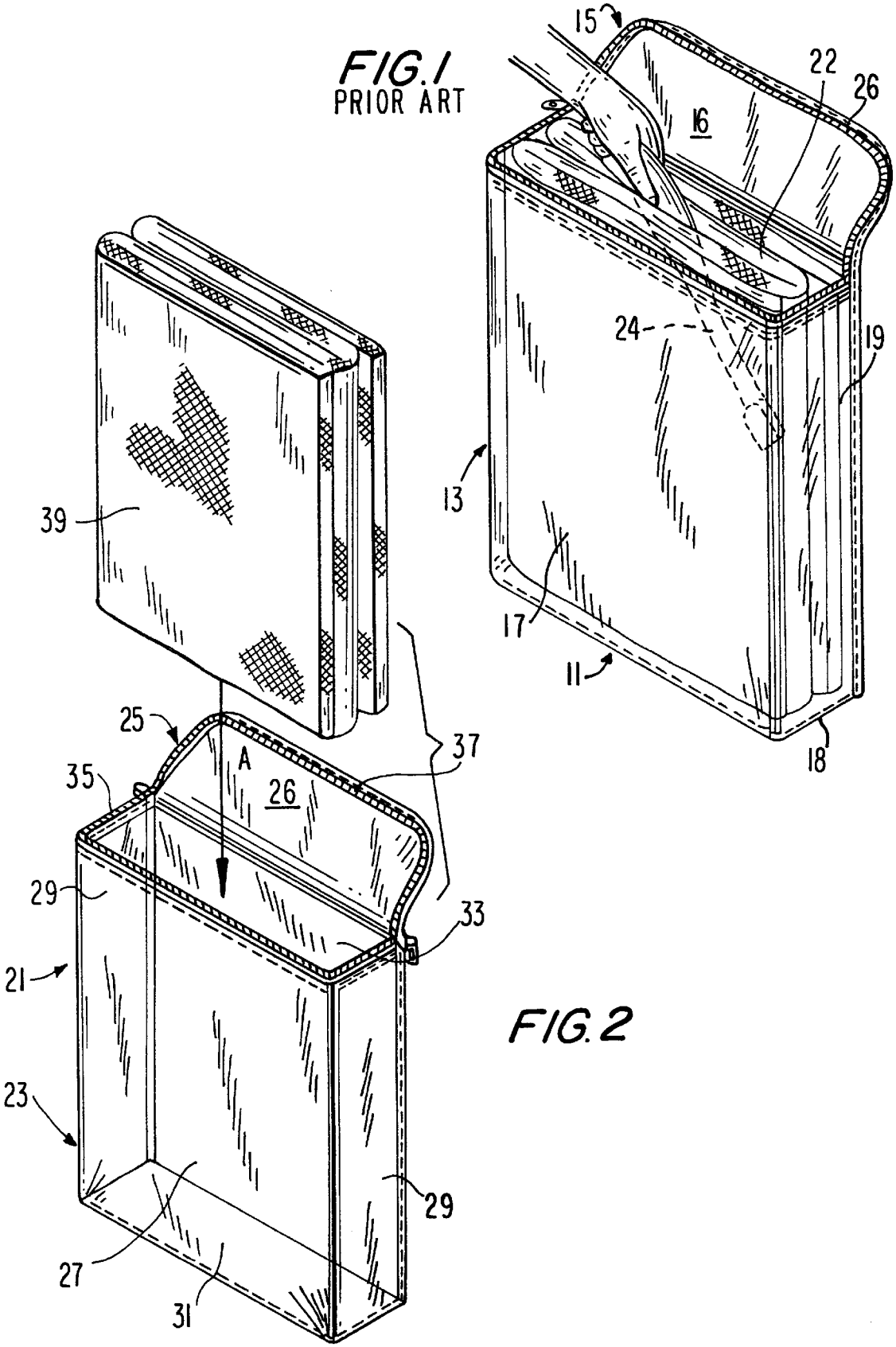
FIG. 1 PRIOR ART
FIG. 1 is a perspective view directed to a storage bag or unit of the prior art.
FIG. 2 is an exploded perspective view of a storage bag or unit made in accordance with the invention and which illustrates placement of a textile product such as a comforter, sheet or bedspread therewithin.

Referring first to FIG. 1, a bag assembly made in accordance with the prior art and generally indicated at 11 is described. Bag assembly 11 consists of a bag unit 13 and a cover element or flap 15. Bag unit 13 is defined by a front wall 17, side walls 19, bottom wall 18, and a back wall (not shown). Bag unit 13 is preferably made from a see-through flexible plastic material, as is well known in the art, that is suitably sized for containing textile products such as sheets, bedspreads and blankets, an example of which is indicated at 22, and is shown retained inside bag unit 13.

Cover element 15 includes a cover member 16 and an edge region 26 along which a conventional zipper mechanism is provided to enable selective access into bag unit 13, as is well known.

As described previously, one disadvantage in selling textile items in large clear plastic bag assemblies of the type indicated at 11 in FIG. 1 is that shoppers often hide one or more small unsold items, such as belt 24, in bag unit 13, in order to pilfer them. It is this problem which is addressed by the inventive storage bag, as described below.

Referring now to FIGS. 2 and 3, a storage bag assembly made in accordance with the invention and generally indicated at 21, is described. Bag assembly 21 consists of a bag unit 23 and a cover element or flap 25. Bag unit 23 is defined by a front wall 27, a pair of side walls 29, a bottom wall 31, and a back wall (not shown), as is well known. Bag unit 23 is preferably made of a see-through flexible plastic material. Bag unit 23 includes an upper rim 35 defining an opening 33 that leads inside bag unit 23. As shown in FIGS. 2 and 3, textile products, such as blanket 39, may be received inside bag unit 23 by being placed through opening 33 in the direction of arrow A.

Cover element 25 of bag assembly 21 consists of a cover member 26 and an outside edge 37. Outside edge 37 of cover element 25 and rim 35 of bag unit 23 together include a lockable zipper system 41 (see FIG. 3), made in accordance with the invention and illustrated in more detail in FIGS. 4 and 5.

Zipper system 41 includes a plurality of interacting zipper teeth 42 of a conventional design and disposed along edge 37 of cover element 25 and rim of bag unit 23 (see FIG. 4), which are selectively engaged and disengaged by operating a pull mechanism generally indicated at 46. Pull mechanism 46, as is well known in the art, includes a slide 43 which runs along interacting teeth 42, and a handle 49 which can be grabbed by the operator in order to move slide 43 in a desired direction along teeth 42 in order to open or close zipper teeth 42 as needed. Handle 49 is formed with an opening 47 at one end thereof through which a hook element 45 is received. Hook element 45 is coupled to slide 43 so that handle 49 can be used to pull slide 43 along teeth 42 in the direction selected.

As shown in FIGS. 4 and 5, handle 49 is formed at the other end thereof with an extending tab 51 having a pair of wing members 53 which are used to engage a female lock element 55, as described in greater detail hereinbelow.

Female lock element 55 is attached along rim 35 of bag unit 23 and away from zipper teeth 41 by means of a flexibly extending plastic element 57. Female element 55 is formed with an inner channel 56 in which tab 51 of handle 49 is sized to be received therewithin. Channel 56 leads to a pair of slots 59 extending on either side thereof, in which wing elements 53 are receivingly engaged in order to lock tab 51 of handle 49 inside of female element 55.

As can be appreciated, when tab 51 of handle 49 is locked into female element 55 by the engagement of wings 53 inside slots 59, handle 49 cannot be separated from female element 55, and thus, zipper system 41 is not operational, thereby preventing tampering of any product retained inside bag unit 23, and also preventing a shopper from hiding a small, unsold item thereinside. However, after purchase, as shown in FIG. 6, the shopper can cut or otherwise sever plastic element 57 so that zipper system 41 becomes operational, in order to open and close bag assembly 21 as desired. This enables the purchaser to have access to blanket 39 or any other item that has been packaged inside bag unit 23 of bag assembly 21.

FIGS. 7 and 8 are similar to FIGS. 4 and 5, and illustrate in detail the zipper locking mechanism of the invention. The only difference is that female locking element 55 is connected to rim 35 of bag unit 23 away from zipper system 41 by means of a string 57A, which, as with plastic element 57, is cut or otherwise severed to enable zipper system 41 to become operational.

Although a clear flexible plastic bag is shown as the preferred bag assembly, any type of bag or container may be utilized in conjunction with the zipper system of the invention without departing from the spirit and scope thereof.

It will thus be seen that the objects set forth above, among those made apparent from the preceding description, are efficiently attained, and since certain changes may be made in the construction described above without departing from the spirit and scope of the invention, it is intended that all matter contained in this description shall be interpreted as illustrative, and not in a limiting sense.

It is also to be understood that the following claims are intended to cover all of the generic and specific features of the invention described herein, and all statements of the scope of the invention which, as a matter of language, might be said to fall therebetween.

What is claimed is:

1. A storage unit comprising:

a container having a rim for defining an opening for access thereinto;

a cover for said container having a border and sized for selective placement over said opening of said container in order to prevent access thereinto;

a zipper mechanism running along at least a portion of said border of said cover and at least a portion of said rim of said cover for enabling selective entry through said container opening and into said container;

a first locking member attached to said zipper mechanism, and a second associated locking member connected to said storage unit away from said zipper mechanism by means of a connecting element;

said first locking member permanently and irremovably interlockable with said second locking member; and said connecting element being severable following interlocking of said first and second locking members.

2. The storage unit of claim 1, wherein said container comprises a flexible bag.

3. The storage unit of claim 2, wherein said flexible bag is a see-through plastic.

4. The storage unit of claim 1, wherein said cover is attached to said container.

5. The storage unit of claim 4, wherein a portion of said border of said cover is attached along said rim of said container.

6. The system of claim 1, wherein said zipper mechanism includes a first row of zipper teeth running along at least a portion of said container rim, and a second row of selectively inter-engaging zipper teeth running along a corresponding portion of said cover border.

7. The storage unit of claim 6, wherein said zipper mechanism includes a slide member overriding said zipper teeth for causing selective inter-engagement thereof.

8. The storage unit of claim 1, wherein said first locking member comprises a handle extending from said zipper mechanism.

9. The storage unit of claim 8, wherein said second locking member comprises a female element for selectively capturing said extending handle.

10. The storage unit of claim 9, wherein said extending handle includes a forward tab designed for locking engagement within said female element.

11. The storage unit of claim 10, wherein said forward tab is formed with at least one wing element for preventing disengagement thereof from within said female element when said handle is captured by said female element.

12. The storage unit of claim 1, wherein said connecting element comprises a string.

13. The storage unit of claim 1, wherein said connecting element comprises a flexible piece of plastic.

14. A zipper locking system for a bag, container or the like, comprising:

a zipper mechanism for opening and closing said bag, container or the like, and comprising first and second rows of selectively inter-engaging teeth and a slide member slidable along said teeth for causing selective inter-engagement thereof;

a handle extending from said slide member of said zipper mechanism for selectively enabling said slide member to slidably move along said teeth;

a female element designed for permanently and irremovably capturing said handle in order to prevent said slide member from slidably moving along said teeth; and a connecting element extending between said female element and said bag, container or the like at a location away from said zipper mechanism and being designed to be selectively cut or severed, thereby enabling said slide member to slidably move along said teeth even when said handle is permanently and irremovably captured by said female element.

15. The storage unit of claim 14, wherein said extending handle includes a forward tab designed for locking engagement within said female element.

16. The storage unit of claim 15, wherein said forward tab is formed with at least one wing element for preventing disengagement thereof from within said female element when said handle is captured by said female element.

17. The storage unit of claim 14, wherein said connecting element comprises a string.

18. The storage unit of claim 14, wherein said connecting element comprises a flexible piece of plastic.

* * * * *